US006283451B1

(12) United States Patent
Stankus et al.

(10) Patent No.: US 6,283,451 B1
(45) Date of Patent: Sep. 4, 2001

(54) HYDRAULIC TENSIONER FOR MINE ROOF SUPPORT CABLES

(75) Inventors: John C. Stankus, Canonsburg, PA (US); Kendal L. Taylor, Masontown, WV (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 09/325,084

(22) Filed: Jun. 3, 1999

Related U.S. Application Data

(60) Provisional application No. 60/088,095, filed on Jun. 5, 1998.

(51) Int. Cl.[7] ..... B21F 9/00
(52) U.S. Cl. ..... 254/228
(58) Field of Search ..... 254/199, 228, 254/384; 14/22, 21

(56) References Cited

U.S. PATENT DOCUMENTS 3,907,338 * 9/1975 Hayes, Jr. et al. ..... 254/228
4,615,509 * 10/1986 Biass ..... 254/228 X
4,641,816 * 2/1987 Kishida et al. ..... 254/228
5,277,406 * 1/1994 Knight ..... 254/228

FOREIGN PATENT DOCUMENTS

1800025 * 10/1968 (DE) ..... 254/199

OTHER PUBLICATIONS

"Mincon Cable Tensioning Jack, Model MTJ–35", BLM Mincon Inc. Mining and Construction Products, 2pp.
"Spring Loaded Ram Model PTJ5s", Florida Wire and Cable Company, 2 pp.

* cited by examiner

*Primary Examiner*—Emmanuel M. Marcelo
(74) *Attorney, Agent, or Firm*—Webb Ziesenheim Logsdon Orkin & Hanson, P.C.

(57) ABSTRACT

A hydraulic cable tensioning device having a main body and tensioning yoke formed from aluminum and being capable of delivering 5,000 psi to tension a cable bearing a barrel and wedge assembly such as in a mine roof bolt or a cable truss. The body defines a pair of cavities which each receive an elongated member bearing a piston which together act as dual action hydraulic cylinders. A cable receiving bore defined in the body receives a cable gripping member to grip the cable while the tensioning yoke pushes against the barrel and wedge assembly in response to forces from the hydraulic cylinders.

7 Claims, 3 Drawing Sheets

HYDRAULIC TENSIONER FOR MINE ROOF SUPPORT CABLES

RELATED APPLICATIONS

This application claims the benefit of U.S. Provisional Application Serial No. 60/088,095 entitled "Hydraulic Cable Tensioner", filed Jun. 5, 1998.

BACKGROUND OF THE INVENTION

1. Field of the Invention

The present invention relates to hydraulic cable tensioners, more particularly, to a portable, lightweight hydraulic cable tensioning device for use in tensioning mine roof cable bolts and cable trusses.

2. Prior Art

Hydraulic cable tensioners have been used to apply tension to a length of installed cable having one fixed end such as a conventional cable bolt having a barrel and wedge assembly or a cable truss having a length of cable terminating with a barrel and wedge assembly. Tension is applied to the installed cable between the barrel and wedge assembly and the fixed end of the cable by pulling on the free end of the cable while urging the barrel and wedge assembly towards the fixed end of the cable.

FIG. 1 depicts a conventional cable tensioning unit U formed of three separate steel cylinders, two being hydraulic cylinders HC coupled together via a yoke Y and a central cylinder CC which receives the cable to be tensioned. Hydraulic fluid is fed to the hydraulic cylinders HC via hydraulic lines L and manifolds M from a remote hydraulic fluid supply unit located at a mining machine. The steel unit U is heavy, typically weighing about eighty pounds, and must be held in one place by one operator at the location of the cable bolt or cable truss to be tensioned while a second operator located at the mining machine operates the controls for the hydraulic fluid delivered to the unit U.

The maximum hydraulic pressure applicable to the unit U is about 2,500 psi resulting in tensioning of an installed cable by about eight tons. This conventional cable tensioner is cumbersome due to its weight and need for two people to install and operate the unit.

Accordingly, a need remains for a hydraulic cable tensioning device which may be readily portable and held overhead by one individual as well as operated at the location of the cable bolt or cable truss to be tensioned.

SUMMARY OF THE INVENTION

This need is met by the hydraulic cable tensioning device of the present invention which is used to induce tension in a cable, the cable having one end fixed to a structure and a free end bearing an attachment assembly. The device includes (1) a unitary body defining a cable receiving bore and an elongated cavity, (2) a cable gripping member received within the cable receiving bore, (3) an elongated member received within the cavity and having a first end extending out of the body, (4) a piston slidably fitted within the cavity and fixed to a second end of the elongated member, thereby defining a first chamber on one side of the piston and a second chamber on an opposite side of the piston and (5) a yoke attached to the first end of the elongated member, the yoke defining a bore aligned with the cable receiving bore and having an abutment surface. The body is preferably formed from aluminum.

When a cable having one end fixed to a structure and a free end bearing an attachment assembly is received in the bore and the piston is urged towards the yoke, the cable gripping member grips the cable while the elongated member moves out of the cavity thereby urging the abutment surface against the attachment assembly and tensioning the cable between the attachment assembly and the fixed end of the cable. Preferably, the body defines a pair of elongated cavities positioned on opposite sides of the bore, each cavity receiving an elongated member with a piston slidably fitted within the cavity and fixed to one end of the elongated member, thereby defining a first chamber on one side of each piston and a second chamber on an opposite side of each piston, with the yoke being fixed to the elongated members. The piston is moveable towards the yoke when pressure within the first chambers is greater than pressure within the second chambers. The pressure in said first chambers is up to about 5,000 psi. The device further includes a pair of hydraulic fluid supply lines and the body further defines (i) a first passageway in fluid communication with one hydraulic fluid supply line and the first chambers and (ii) a second passageway in fluid communication with the other hydraulic fluid supply line and the second chambers.

DESCRIPTION OF THE PREFERRED EMBODIMENTS

Figure 1:
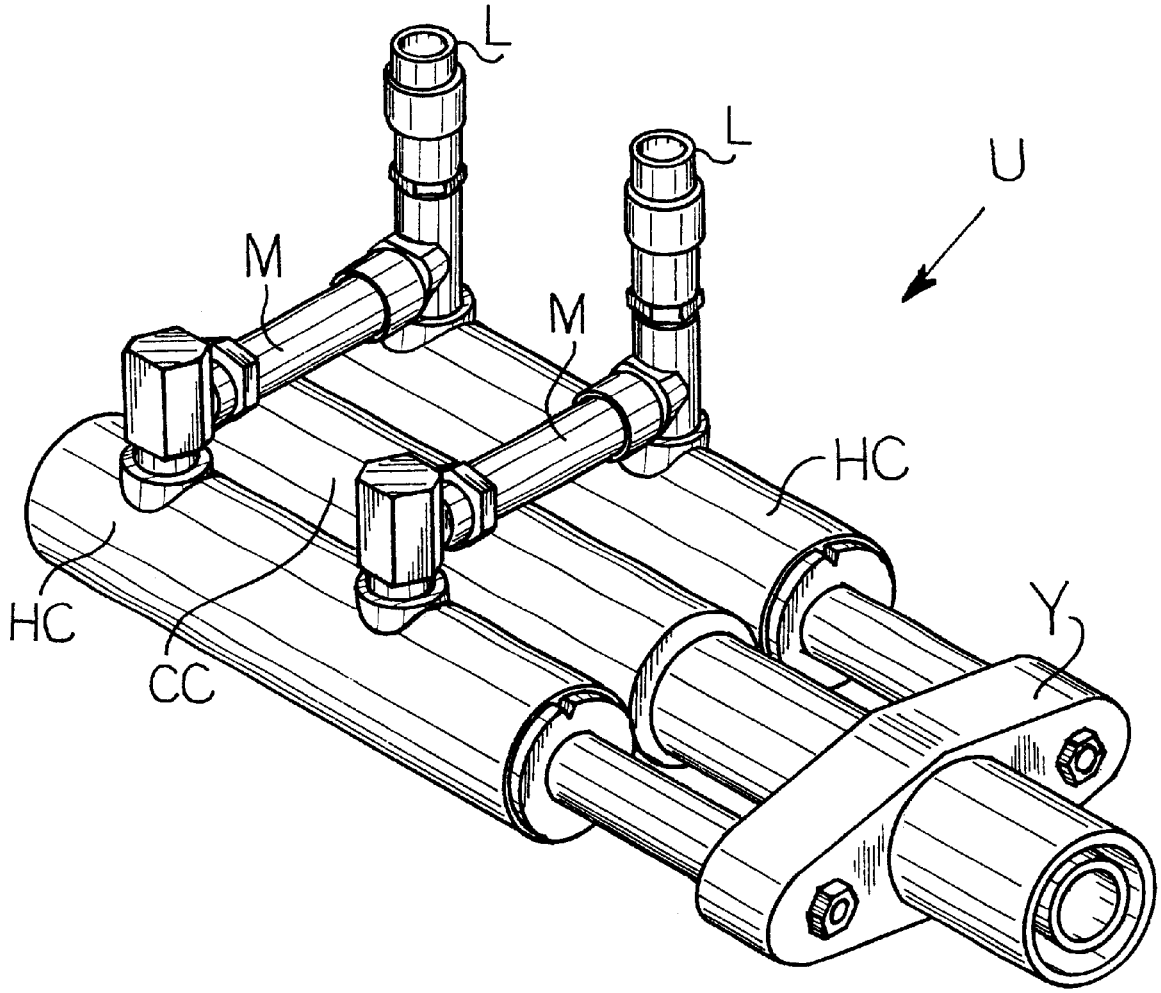
Fig. 1 PRIOR ART
FIG. 1 is a perspective view of a cable tensioning unit of the prior art.

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
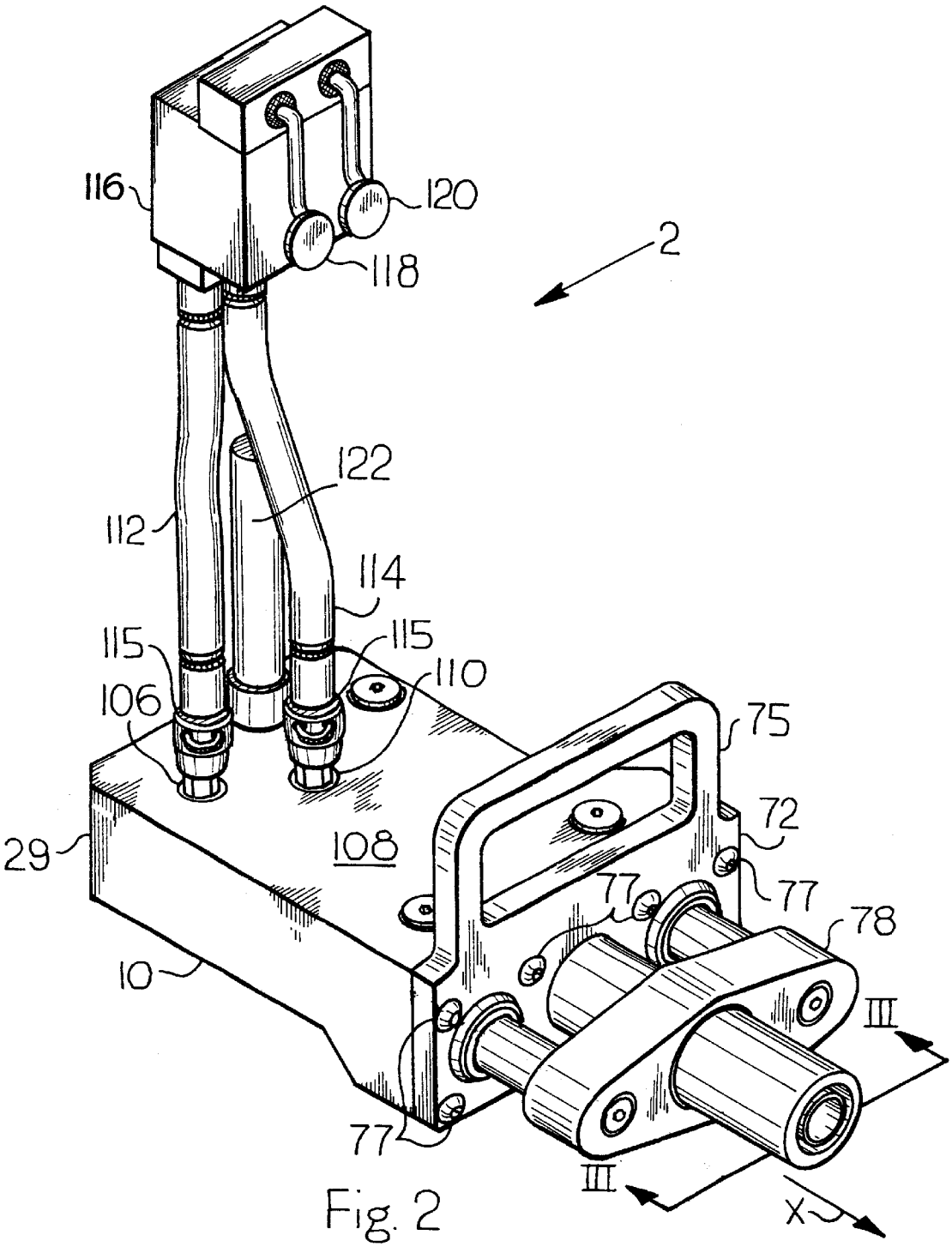
FIG. 2 is a perspective view of a hydraulic cable tensioning device made in accordance with the present invention with cross-section lines III—III passing from a yoke end to a first end of the cable tensioner device.
Figure 3:
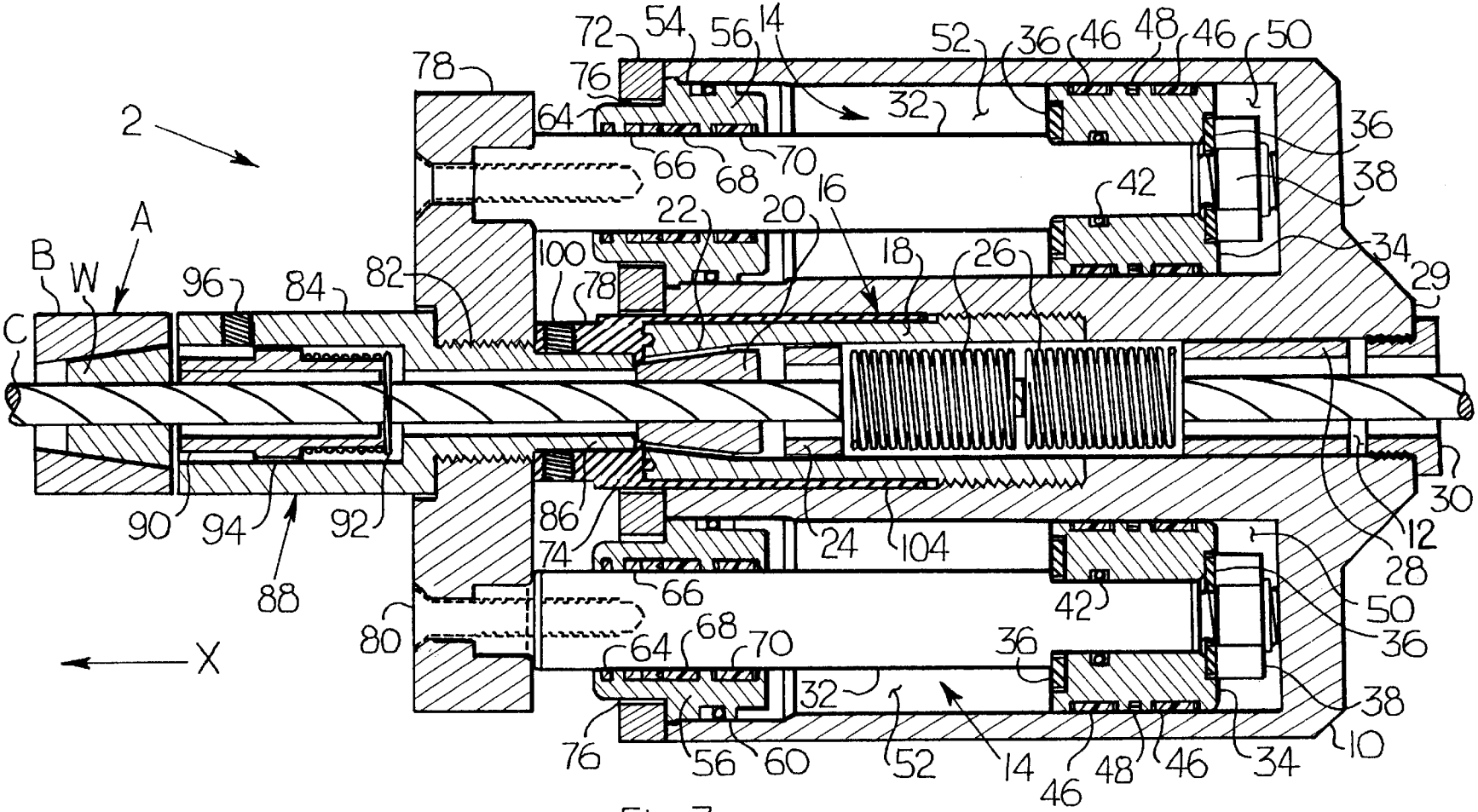
FIG. 3 is a reversed cross section view of the hydraulic cable tensioner depicted in FIG. 2 taken along lines III—III, with the yoke end oriented in relation to direction X and the front end. in use with a cable bearing a barrel and wedge assembly.

The hydraulic cable tensioning device 2 of the present invention is illustrated in FIGS. 2 and 3 and is configured for use with a length of cable C having an attachment assembly A typically including a barrel B and a plurality of wedges W received therein. The cable C may be a galvanized steel multi-strand cable conforming to ASTM designation A 416 entitled, "Standard Specification for Steel Strand Uncoated Seven Wire for Prestressed Concrete." One end of the cable C is installed in a structure (not shown), such as rock strata or a portion of a mine roof cable truss, and thus is fixed to that structure. The attachment assembly A is positioned on the cable intermediate the fixed end of the cable C and a free end (commonly referred to as a pigtail) of the cable. The attachment assembly A may act as a loading bearing mechanism (for a mine roof bolt) or as a holding mechanism (in a cable truss). The hydraulic cable tensioner 2 is configured to apply tension in the cable C between the fixed end of the cable C and the attachment assembly A.

The hydraulic cable tensioning device 2 includes a unitary body 10 which defines a cable receiving bore 12 extending the length of the body 10 and a pair of elongated cavities 14. A cable gripping member 16 is received within the cable receiving bore 12. The cable gripping member 16 includes an externally threaded sleeve 18 and a plurality of gripping members or tapered wedges 20. The sleeve 18 has an internally tapered inner surface shown at 22 which cooperates with the tapered surfaces of the wedges 20. A first spacer 24, a pair of springs 26 and a second spacer 28 are received within the cable receiving bore 12 between the wedges 20 and a first end 29 of the body 10. A cap 30 having an aperture therethrough is threaded into the first end 29 of the body 10.

An elongated member 32 is received within each of the elongated cavities 14. A piston 34 slidably fitted within each cavity 14 surrounds a narrowed end portion of each elongated member 32 and is fixed thereto via washers 36 and a locking nut 38 threaded onto the elongated member 32. In this manner, the portions of the body 10 defining the cavities 14 act as piston receiving members. A groove is defined in an inner surface of the piston 34 and receives an o-ring 42. A pair of first channels are defined in an outer surface of each piston 34 and each receive a wear band 46, preferably formed of rubber or other pliable material. A groove is also defined in the piston outer surface and receives a dynamic seal 48. Each piston 34 divides the cavity 14 into a first chamber 50 and a second chamber 52. The o-ring 42 and the dynamic seal 48 prevent leakage of fluid between the first and second chambers 50 and 52. The wear bands 46 minimize any damaging effect that the pistons 34 may have on the body 10 when the pistons 34 slide through the cavities 14 as described below.

The elongated cavities 14 terminate in a pair of openings in the body 10 which each receive a collar 56. A groove defined in an outer surface of the collars 56 receives an o-ring 60. A groove is defined in an inner surface of the collars 56 and receives a wiper ring 64. A pair of second channels also are defined in each of the collar inner surfaces. One of the second channels receives a back-up sealing ring 66, a dynamic seal 68 and a wear band 70, preferably formed of rubber or other pliable material. The other of the second channels also receives a wear band 70. The o-ring 60 and the dynamic seal 68 prevent leakage of fluid out of the second chamber 52. The wiper ring 64 and back-up sealing ring 66 function to prevent extraneous fluid or particulate matter from entering into the cavity 14. The wear bands 70 minimize any damaging effect that the collars 56 may have on the elongated members 32 when the elongated members 32 slide through the collars 56 as described below.

A face plate 72 covers the second end of the body 10 and portions of the collars 56. The face plate 72 defines a first aperture 74 aligned with the cable receiving bore 12 and pair of second apertures 76 aligned with the cavity openings. Handle 75, preferably integrally formed, extends from the face plate 72. As shown in FIG. 2, a plurality of fasteners 77 such as screws extend through mating holes defined in the face plate 72 and the body 10 to secure the face plate 72 thereto.

The tensioner 2 further includes a yoke 78 which is coupled to the elongated members 32 via a pair of pins 80. The yoke 78 defines a threaded aperture 82 aligned with the cable receiving bore 12 in the body 10. A tubular insert 84 is threaded into the yoke aperture 82. One end 86 of the insert 84 extends towards the body 10 and the other end of the insert 84 extends in an opposite direction and includes an enlarged portion 88. The outside diameter of the enlarged portion 88 is sized to be about the same as the outside diameter of the barrel B of the attachment assembly A. An inner sleeve 90 is received within the enlarged portion 88. The sleeve 90 has an outside diameter which is sized to be about the same as the outside diameter of the wedges W of the assembly A. A spring 92 surrounds one end of the sleeve 90, and the sleeve 90 includes a radial rib 94 against which the spring 92 bears. A set screw 96 may be threaded through the insert on an opposite side of the rib 94 from the spring 92.

A centralizing member 98 surrounds the insert end 86 and is fixed thereto via set screws 100 extending through the centralizing member 98. The centralizing member 98 further includes a sleeve 104 having an inner diameter sized and configured to receive the sleeve 18 therein. The sleeve 104 functions to prevent fluid or particulate matter from entering the cable receiving bore 12 when the yoke 78 and the centralizing member 98 move away from the body 10 as described below.

The body 10 further defines a pair of branched passageways (not shown) in fluid communication with the first and second chambers 50 and 52. One passageway communicates with the first chambers 50 and a port 106 defined in a surface 108 of the body 10. The other passageway communicates with the second chambers 52 and a port 110 defined in the body surface 108. Hydraulic fluid supply lines 112 and 114 are connected to the ports 106 and 110, respectively, via suitable fittings 115. The hydraulic fluid supply lines 112 and 114 are closely coupled to a hydraulic fluid control unit 116 with actuating levers 118 and 120 for delivery and removal of hydraulic fluid. Although not shown in the drawings, additional hydraulic fluid lines are also connected to the control unit 116 from a main hydraulic fluid source. The body 10 further includes a handle 122.

The hydraulic cable tensioning device 2 may be used to induce tension in a cable mine roof bolt or a cable in a truss. For tensioning a cable bolt, the bolt is installed in a bore hole in a mine roof either in a vertical, horizontal or angled orientation with resin cartridges in a conventional manner. A bearing plate having an aperture therethrough is slipped over the cable bolt. A barrel and wedge assembly is positioned on the free end of the cable bolt so that the barrel and wedge assembly urges the bearing plate against the mine roof. The cable bolt is sufficiently long that a length of cable (e.g., two feet) extends out of the barrel and wedge assembly into the mining chamber. The cable bolt is rotated to destroy the resin cartridges and mix the resin. Once the resin is mixed sufficiently, it is allowed to set. After the resin sets, the cable bolt may be tensioned by operation of the hydraulic cable tensioning device 2.

The free end of the cable C is passed through the insert 84 with inner sleeve 90 and spring 92, the centralizing member 98 and into the cable receiving bore 12, through the sleeve 18 and wedges 20, the first spacer 24, springs 26 and second spacer 28 and out through the cap 30 until the barrel B abuts the end of the insert 84 and the wedges W abut the end of the inner sleeve 90. The wedges 20 grip the cable C within the cable gripping member 16. Hydraulic fluid is fed through the passageways into the body and into the first chambers 50 by actuating the lever 118. As the hydraulic fluid fills the first chambers 50, the pressure in the first chambers 50 becomes greater than the pressure in the second chambers until the pistons 34 and elongated members 32 fixed thereto are forced to move in the direction of arrow X shown in FIGS. 2 and 3. Movement of the elongated members 32 causes the yoke 78 and the insert 84 with the inner sleeve 90 to likewise move in the direction of arrow X. By abutting the barrel and wedge assembly A against the ends of the insert 84 and the inner sleeve 90, respectively, the barrel B and wedges W are prevented from moving relative to each other during tensioning and the entire attachment assembly A moves in the direction of arrow X. The wedges 20 are also urged in the direction of arrow X until they lock against the tapered inner surface 22 thereby gripping the cable C and preventing the cable C from moving in the direction of arrow X. The force applied by the elongated members 32 and yoke 78 is counteracted by the gripping force of the cable gripping member 16 to induce tension in the cable C.

When the desired tension has been applied to the cable C, the flow of hydraulic fluid to the first chambers 50 is ceased. Hydraulic fluid is fed through the passageways in the body and into the second chambers 52 by actuating the lever 120. As the hydraulic fluid fills the second chambers 52, the pressure in the second chambers 52 becomes greater than the pressure in the first chambers 50 which forces the pistons 34 and elongated members 32 to move in a direction opposite to that of arrow X. The yoke 78 likewise moves in the direction opposite to arrow X, and the end 86 of the insert 84 travels back until it abuts the ends of the wedges 20 and ultimately knocks the wedges 20 away from the cable C so that the hydraulic tensioning device 2 may be removed from the cable C. Hydraulic fluid remaining in the first and second chamber 50 and 52 may then be drained.

The hydraulic cable tensioning device 2 may be used to tension the end of a cable in a cable truss such as disclosed in U.S. Pat. No. 5,836,720, incorporated herein by reference. When used with a cable truss, a length of cable is extended through a splice tube or the like and a barrel and wedge assembly is installed on the free end of the cable extending from the splice tube and adjacent thereto. The hydraulic cable tensioning device 2 is operated in a similar manner to its use in tensioning a cable bolt.

The hydraulic cable tensioning device 2 of the present invention is preferably made of aluminum with the exception of certain of the smaller components such as the sleeve 18, wedges 20, spacers 24 and 26, cap 30, insert 84, and inner sleeve 92, which are preferably formed of steel to prevent wear thereof. The body 10 is preferably formed of a unitary piece of aluminum. By the use of aluminum for the body 10, the weight of the hydraulic cable tensioning device 2 is greatly reduced from the weight of the hydraulic tensioners of the prior art and typically is about twenty pounds. The design of the simple, unitary body 10 renders the hydraulic cable tensioning device 2 relatively easy to manufacture and assemble. A single mining operator can readily hold the hydraulic cable tensioning device 2 overhead and simultaneously operate the hydraulic levers 118 and 120 at the location of the cable C to be tensioned. The need for a second operator is avoided because one person can install and operate the hydraulic cable tensioning device 2. The hydraulic cable tensioning device 2 is thus more portable and safer to use overhead in the mining environment than the heavy, cumbersome hydraulic tensioners of the prior art.

In addition, the unitary block design of the hydraulic cable tensioning device of the present invention allows for delivery of a much higher hydraulic pressure and concomitant greater tensioning than the prior art tensioners. It has been found that hydraulic pressure of about 5,000 psi may be applied to the hydraulic cable tensioning device of the present invention resulting in about sixteen tons of tensioning force applied to the cable.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. A tensioning device for inducing tension in a cable having a fixed end, said tensioning device comprising:

a unitary body defining a cable receiving bore and an elongated cavity;

a cable gripping member received within said cable receiving bore;

an elongated member received within said cavity and having a first end extending out of said body;

a piston slidably fitted within said cavity and fixed to a second end of said elongated member, thereby defining a first chamber on one side of said piston and a second chamber on an opposite side of said piston; and a yoke attached to said first end of said elongated member, said yoke defining a bore aligned with said cable receiving bore and having an abutment surface, wherein said tensioning device is capable of being held overhead and simultaneously operated by a single operator, and said first chamber is able to receive an operating pressure of up to about 5,000 psi.

2. The device as claimed in claim 1 wherein said body defines a pair of elongated cavities positioned on opposite sides of said bore, each said cavity receiving an elongated member with a piston slidably fitted within said cavity and fixed to one end of said elongated member, thereby defining a first chamber on one side of each said piston and a second chamber on an opposite side of each said piston, said yoke being fixed to said elongated members.

3. The device as claimed in claim 2 wherein said piston is moveable towards said yoke when pressure within said first chambers is greater than pressure within said second chambers.

4. The device as claimed in claim 2 wherein said body is formed from aluminum.

5. The device as claimed in claim 2 further comprising a pair of hydraulic fluid supply lines, wherein said body further defines (i) a first passageway in fluid communication with one said hydraulic fluid supply line and said first chambers and (ii) a second passageway in fluid communication with the other said hydraulic fluid supply line and said second chambers.

6. A tensioning device for inducing tension in a cable, the device including (1) a body having an elongated cable receiving portion and a pair of piston receiving members positioned on opposite sides of the cable receiving member, (2) a cable gripping member received within the cable receiving member, (3) an elongated member received within each piston receiving member and having a first end extending out of the body, (4) a piston slidably fitted within each piston receiving member and fixed to a second end of the elongated member, thereby defining a first chamber on one side of the piston and a second chamber on an opposite side of the piston, and (5) a yoke attached to the first ends of the elongated members, the yoke defining a bore aligned with the cable receiving member and having an abutment surface, wherein the improvement comprises:

said body being an aluminum unitary member, said tensioning device capable of being held overhead and simultaneously operated by a single operator, and said first chamber able to receive an operating pressure of up to about 5,000 psi.

7. The device as claimed in claim 6 wherein the improvement further comprises:

a pair of hydraulic fluid supply lines, wherein the body further defines (i) a first passageway in fluid communication with one said hydraulic fluid supply line and said first chambers and (ii) a second passageway in fluid communication with the other said hydraulic fluid supply line and said second chambers.

* * * * *